United States Patent [19]

Bolt et al.

[11] 4,340,072

[45] Jul. 20, 1982

[54] SMOKEABLE DEVICE

[75] Inventors: Anthony J. N. Bolt; Brian C. Chard, both of Bristol, England

[73] Assignee: Imperial Group Limited, London, England

[21] Appl. No.: 206,068

[22] Filed: Nov. 12, 1980

[51] Int. Cl.[3] ..... A24D 1/00

[52] U.S. Cl. ..... 131/273; 131/337; 131/360; 131/274

[58] Field of Search ..... 131/273, 274, 337, 360

[56] References Cited

U.S. PATENT DOCUMENTS

| | | | |
|---|---|---|---|
| 3,258,015 | 6/1966 | Ellis et al. | 131/273 |
| 3,279,476 | 10/1966 | Noznick et al. | 131/337 |
| 3,356,094 | 12/1967 | Ellis et al. | 131/360 X |
| 4,227,540 | 10/1980 | Edison | 131/274 X |

*Primary Examiner*—Stephen C. Pellegrino

*Attorney, Agent, or Firm*—Larson and Taylor

[57] ABSTRACT

A smokeable device has an annular fuel rod in gaseous communication with a mouth-end chamber. The chamber contains a quantity of inhalent material which, when contacted by hot gases during smoking forms an aerosol for inhalation by the smoker.

8 Claims, 4 Drawing Figures

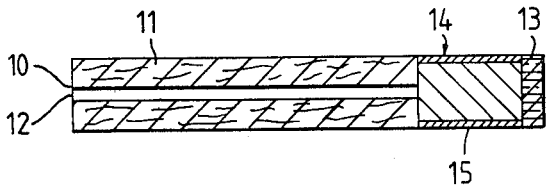
Fig. 1.
Fig. 2.
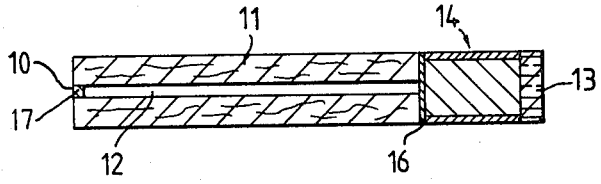
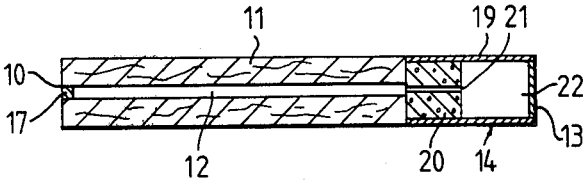
Fig. 3.
Fig. 4.
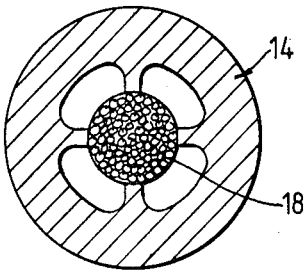

SMOKEABLE DEVICE

TECHNICAL FIELD

Among the reasons why most people smoke conventional cigarettes is that they wish to inhale an aerosol containing nicotine. However, when smoking such cigarettes not only is some nicotine lost by pyrolysis and to sidestream during smoulder between puffs, but, in addition, objectionable compounds such as carbon monoxide are also inhaled.

The present invention provides a smokeable device in which the above disadvantages are at least substantially avoided.

BACKGROUND ART

A previously proposed smokeable device which aimed at avoiding the abovementioned disadvantages is described in U.S. Pat. No. 3,356,094 in the name of C. D. Ellis et al. This comprised a tube formed of tobacco having a mouthpiece attached at one end. An axial inner tube of material which is frangible under heat is contained within the tobacco tube and is coated on its inner surface with an additive material such as nicotine. Thus, on smoking, hot gases are drawn up the inner tube and release the nicotine in the form of an aerosol for inhalation by the smoker. However, with this device there is an appreciable loss of nicotine and other desirable compounds such as flavourants during smoulder. There is also a tendency for the inner tube to protrude unattractively from the burning end during smoking.

INVENTION

A cigarette-simulatire smokeable device for releasing an aerosol into the mouth of a smoker comprising:

(a) a rod of fuel having a longitudinally extending passage therethrough;

(b) a chamber in gaseous communication with an end of the passage whereby during smoking hot gases from the burning fuel rod enter the chamber (c) inhalant material located in the chamber which when contacted by the hot gases during smoking, forms an aerosol for inhalation by the smoker, (d) the chamber having at an end remote from the fuel rod a mouth-end closure member which is permeable to the aerosol.

The chamber and the mouth-end closure member are preferably of unitary construction and may be formed by moulding or extruding a conventional smoke filter plug to provide a chamber to contain the inhalant material.

Preferably the fuel rod is a moulding or extrusion of reconstituted tobacco and/or tobacco substitute.

The wall of the fuel rod is preferably impermeable to air.

The inhalant material may comprise nicotine source material or spray dried granules of flavourant whose composition lies within the range 30–60% by weight of a solution of flavourant in triacetin or benzyl benzoate encapsulated in 40–70% by weight of gum acacia or a modified starch. The inhalant material may further comprise microcapsules formed by e coacervation method which capsules comprise 50–80% by weight of flavourant in a mixture of galatin and gum acacia.

Preferably the end of the fuel rod to be lighted is closed by a combustible member.

DRAWINGS

The invention will now be described by way of example with reference to the accompanying diagrammatic drawings in which:

FIG. 1, FIG. 2 and FIG. 3 are longitudinal sections through first, second and third embodiments of a smokeable device; and FIG. 4 shows a section through a chamber for containing inhalant material.

The smokeable device shown in FIG. 1 comprises a generally cylindrical fuel rod 11 extruded or moulded from tobacco or a tobacco substitute. An example of such a tobacco substitute is that described in our U.K. Pat. No. 1,113,979. An axial passage 12 extends the length of the fuel rod 11. The wall of the rod 11 is substantially impervious to air so that when an end is lighted the flow of moist hot gases produced during combustion is confined to pass down passage 12 towards aerosol precursor chamber 14 during smoking. A conventional cellulose paper filter tip 13 is provided at an end of the device remote from the fuel rod. The filter is preferably as short as practicable as its purpose is merely to close the end of chamber 14.

Chamber 14 comprises a cylindrical body 15 which is formed of an air impermeable cellulosic material such as cellulose acetate or paper. The aerosol precursor (or inhalant) material contained in the chamber 14 comprises a volatile flavourant solution micro-encapsulated in gum acacia heat rupturable granules of 16–52 mesh size.

In use, when the end 10 of the fuel rod is lighted, air is drawn axially through the device when a smoker takes a puff. Air entering the passage 12 passes the burning coal and is heated and mixed with the combustion gases from the burning rod. This stream of hot gases passes down the passage 12 and between the granules of the precursor material to exit through the filter tip 13 into the mouth of the smoker. The flow of hot gases through the precursor material ruptures the microcapsules and releases the volatile solution to form an aerosol of flavourant. Thus the smoker inhales an aerosol of flavourant substantially free from toxic compounds with each puff on the device.

The overall length of the device is 70 mm, the diameter is 7 mm and the diameter of the passage 12 is 2.2. mm.

The embodiment shown in FIG. 2 is generally similar to that shown in FIG. 1 but differs in the design of the aerosol precursor chamber 14. In this embodiment the chamber 14 and the filter tip 13 are formed as an integral unit in the following manner. A conventional collulose acetate filter tip has a chamber 14 moulded in one end by the insertion of a hot forming probe. Inhalant material in the form of a spray dried powder is then injected into the chanber 14. As this material is insufficiently adhesive to be retained in the chamber, an air porous disc 16 is provided between the chamber and the fuel rod 11. A combustile plug 17 located in the open end 10 of the fuel rod to close the passage 12 assists even lighting of the rod and helps to make the device resemble a conventional cigarette. The plug 17 is formed of the same material as the fuel rod. Plug 17 may also have the form of a disc having the same area as the cross-section of the fuel rod 11.

In use, with smokeable devices of either embodiment, the temperature of the burning coal is in the region of 800° C. and the temperature of the air mixture down-stream at the inhalant material varies between 130° C. and 500° C. during the smoking of the device.

FIG. 3 shows a further embodiment of smoking device which again differs in the design of the aerosol chamber 14. The chamber 14 comprises a cylinder 19 moulded from cellulose acetate which is closed at the mouthpiece end by a cellulose-paper filter 13. Adjacent the end of the fuel rod 11 the chamber 14 contains an annular cartridge 20 formed of flavourant-containing spray-dried gum acacia microcapsules. The annular cartridge 20 defines a tubular passage 21 which connects with the axial passage 12 in the fuel rod 11. The remaining portion of the chamber 14 forms an aerosol mixing chamber 22. In use hot, moist gases are drawn down passage 12 and into passage 21 where they pass over the microcapsules causing them to rupture and release their flavourant. The flavourant-containing gases pass into the mixing chamber 22 where they expand and inter-mix thus ensuring an evenly distributed aerosol.

FIG. 4 shows a section through a further embodiment of precursor chamber 14. Cellulosic material 18 is extruded in lengths having the section shown. During the extrusion a length of flavourant-containing material is simultaneously extruded axially through the length of the outer extrusion. The resulting extrusion is then cut into short lengths each of which forms an integral aerosol precursor chamber. Alternative sections to that shown in FIG. 3 may be used. It is also envisaged that the flavourant containing material may be added independently to pre-prepared chambers 14.

In order to assess the performance of smokeable devices as described above experiments were carried out to determine the yield of a flavourant into the mainstream aerosol during smoking. Triacetin and hexadecane were selected in place of nicotine as these behave in a similar fashion to nicotine but are easier to detect experimentally. The tests used the normal smoking regime of 1 puff of 2 seconds duration and 35 ml volume every minute.

A test carried out with the embodiment of FIG. 1 used triacetin spray-dried in gum acacia. The particles were sieved and only those of 16–52 mesh size were used. The triacetin transfer into the mainstream aerosol was between 0.57 and 1.17 mg. Where the test was carried out using nicotine in place of triacetin the yield was 0.77 mg.

A test was carried out using the embodiment of FIG. 2 and the same flavourant-containing material as in the previous test. With this embodiment the triacetin transfer was between 0.9 and 1.85 mg.

Finally the embodiment of FIG. 3 was tested. In this embodiment hexadecane was used to simulate the flavourant. The yield into the mainstream aerosol was 0.83 mg.

The fuel rod 11 may in either embodiment have a conventional cigarette paper wrapped around it. The rod may further be formed of a mixture of tobacco substitute material and carbon or alternatively formed of other suitable combustible material, e.g. wood pulp, straw and heat-treated cellulose or an SCMC and carbon mixture.

It is envisaged that the aerosol chamber 14 of FIG. 3 could be prepared from a rectangular piece of cellulose acetate having a band of flavourant-containing material applied along one of its edges. The rectangular piece would be rolled to form a tube and the abutting edges would then be joined. As a result of the rolling, the band of flavourant-containing material would adopt the annular form 20 of FIG. 3.

The aerosol material may, as an alternative to a flavourant solution, comprise a solution of a flavourant and/or nicotine in triacetin or benzyl benzoate. Any psycho-active or physiologically active compound such as ephedrine or a nicotine/ephedrine mixture may be used as may emollients, smoothing agents or amerliorants.

The inhalant material may comprise nicotine encapsulated in a spray dried powder. Alternatively the nicotine may be encapsulated in an expanded matrix of a thermoplastic material .eg. polyurethane.

The inhalant, or flavour-containing material may comprise nicotine source material or spray dired granules of flavourant whose composition lies within the range 10–100%, but preferably 30–60% by weight of a solution of flavourant in triacetin or benzyl-benzoate encapsulated in 10–70%, but preferably 40–70% by weight of gum acacia or a modified starch. The inhalant material may further comprise microcapsules formed by the coacervation method which capsules comprise 10–90%, but preferably 50–80% by weight of flavourant in gum acacia, gelatin, or a mixture thereof.

As an alternative to gum acacia the flavourant-containing material could comprise gelatin.

The fuel rod may be impregnated with burn-modifying material e.g. potassium citrate. The fuel rod may also be impregnated with fragrances which are released on smoking.

In the case where the inhalant material comprises a spray dried powder the need for the provision of an air porous disc 16 may be obviated if after injecting the powder into the chamber 14, the filter tip is left to stand in conditions of high humidity. This method results in the powder becoming adhered to the inner surfaces of the chamber 14.

Thus the smoking devices described in accordance with the invention provide a means of controlling the substances which are released into the mainstream smoke. The loss of the inhalant material by pyrolysis and to sidestream during smoulder is also minimised. Additionally such smoking devices closely resemble normal cigarettes in appearance.

I claim:

1. A cigarette-simulating smokeable device for releasing an aerosol into the mouth of a smoker comprising:
   (a) a rod of fuel having a longitudinally extending passage therethrough;
   (b) a chamber in gaseous communication with an end of the passage whereby during smoking hot gases from the burning fuel rod enter the chamber
   (c) inhalant material located in the chamber which, when contacted by the hot gases during smoking forms an aerosol for inhalation by the smoker,
   (d) the chamber having at an end remote from the fuel rod a mouth-end closure member which is permeable to the aerosol.

2. A device as claimed in claim 1 in which the chamber and the mouth-end closure member are of unitary construction and may be formed by moulding or extruding a conventional smoke filter plug to provide a chamber to contain the inhalant material.

3. A device as claimed in claim 1 in which the fuel rod is a moulding or extrusion of reconstituted tobacco and/or tobacco substitute.

4. A device as claimed in claim 3 in which the wall of the fuel rod is impermeable to air.

5. A device as claimed in claim 1 in which the inhalant material comprises nicotine source material whose composition lies within the range 30–60% by weight of a solution of nicotine source material in triacetin or benzyl benzoate encapsulated in 40–70% by weight of gum acacia or a modified starch.

6. A device as claimed in claim 5 in which the inhalant material further comprises microcapsules formed by the coacervation method which capsules comprise 50–80% by weight of flavourant in a mixture of gelatin and gum acacia.

7. A device as claimed in any preceding claim in which the end of the fuel rod to be lighted is closed by a combustible member.

8. A device as claimed in claim 1 in which the inhalant material comprises spray dried granules of flavourant whose composition lies within the range 30–60% by weight of a solution of flavourant and triacetin or benzyl benzoate and capsulated in 40–70% by weight of gum acacia or a modified starch.

* * * * *